US008894252B2

(12) United States Patent
Chen et al.

(10) Patent No.: US 8,894,252 B2
(45) Date of Patent: Nov. 25, 2014

(54) FILAMENT LED LAMP

(71) Applicant: Technical Consumer Products, Inc., Aurora, OH (US)

(72) Inventors: Timothy Chen, Aurora, OH (US); George Uhler, Wadsworth, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 11 days.

(21) Appl. No.: 13/866,652

(22) Filed: Apr. 19, 2013

(65) Prior Publication Data

US 2014/0313748 A1 Oct. 23, 2014

(51) Int. Cl.

| | |
|---|---|
| ***F21V 3/00*** | (2006.01) |
| ***F21V 29/00*** | (2006.01) |
| ***F21K 99/00*** | (2010.01) |

(52) U.S. Cl.

CPC ..... *F21V 29/004* (2013.01); *F21K 9/90* (2013.01); *F21V 3/00* (2013.01)

USPC ..... 362/363; 362/311.02; 362/294; 362/237

(58) Field of Classification Search

USPC ..... 362/311.02, 237, 238, 294, 249.02; 257/98, 712

See application file for complete search history.

(56) References Cited

U.S. PATENT DOCUMENTS

| | | | | |
|---|---|---|---|---|
| 6,598,996 | B1 * | 7/2003 | Lodhie | 362/249.05 |
| 7,549,774 | B2 * | 6/2009 | Tsai | 362/294 |
| 7,758,223 | B2 * | 7/2010 | Osawa et al. | 362/547 |
| 7,800,909 | B2 * | 9/2010 | Sun | 361/709 |
| 7,976,182 | B2 * | 7/2011 | Ribarich | 362/221 |
| 8,408,747 | B2 * | 4/2013 | Wang et al. | 362/294 |
| 8,591,062 | B2 * | 11/2013 | Hussell et al. | 362/249.01 |
| 2006/0050514 | A1 * | 3/2006 | Opolka | 362/294 |
| 2010/0264799 | A1 * | 10/2010 | Liu et al. | 313/46 |
| 2010/0277067 | A1 * | 11/2010 | Maxik et al. | 315/32 |
| 2011/0128742 | A9 * | 6/2011 | Yuen et al. | 362/294 |

* cited by examiner

*Primary Examiner* — Ali Alavi
(74) *Attorney, Agent, or Firm* — Thompson Hine L.L.P.

(57) ABSTRACT

An LED lamp includes a thermally conductive base including an appendage protruding from a center of a first end and an opening to cavity on a second end. The appendage includes a channel coupled to the cavity. The LED lamp further includes an LED assembly disposed at an end of the protruding appendage and in thermal communication with the base. The LED assembly further includes a bulb disposed on the first end, wherein the appendage protrudes in a direction towards the center of the bulb, and wherein the LED assembly is proximate to the center of the bulb. The LED assembly further includes an electrical housing, configured to house an electrical module, disposed inside the cavity of the base. An electrical wire disposed inside the channel electrically couples the LED assembly to the electrical module.

15 Claims, 4 Drawing Sheets

FILAMENT LED LAMP

FIELD OF DISCLOSURE

The present disclosure relates to the field of lamps. More particularly, the present disclosure relates to LED lamps.

BACKGROUND

Incandescent light bulbs produce light when a filament wire is heated by a passing electric current. Incandescent light bulbs are commonly used in a variety of applications. Incandescent light bulbs, however, may be less efficient and less effective than LED bulbs, and are therefore commonly replaced with more efficient and more effective LED bulbs.

An LED light source, however, is more compact in size and the lumen output is more sensitive to operating temperature. An LED lamp may therefore require heat dissipating features for adequately dissipating heat to prevent the LED from overheating and failing, which an incandescent lamp may not require. In addition, an LED lamp does not heat a filament wire to generate light. Rather, an LED is a semiconductor light source. Thus, incorporating an LED into lamp, including a heat sink, may alter the appearance of the lamp, which may not be desirable.

SUMMARY OF THE DISCLOSURE

An LED lamp includes a thermally conductive base including an appendage protruding from a center of a first end and an opening to cavity on a second end. The appendage includes a channel coupled to the cavity. The LED lamp further includes an LED assembly disposed at an end of the protruding appendage and in thermal communication with the base. The LED assembly further includes a bulb disposed on the first end, wherein the appendage protrudes in a direction towards the center of the bulb, and wherein the LED assembly is proximate to the center of the bulb. The LED assembly further includes an electrical housing, configured to house an electrical module, disposed inside the cavity of the base. An electrical wire disposed inside the channel electrically couples the LED assembly to the electrical module.

A method for assembling a Filament LED lamp comprises the step of disposing an LED assembly comprising an LED on a protruding appendage extending from the center of a first side of a thermally conductive base. The method further comprises the step of disposing an electrical module inside an electrical housing. The method further comprises the step of extending a wire, coupled to the electrical module, to the LED assembly, through a channel in the protruding appendage, the channel connecting an opening at the top of protruding appendage and a cavity inside the thermally conductive base. The method further comprises the step of inserting the electrical housing into the cavity of the thermally conductive base, through an opening on a second side of the base. The method further comprises the step of securing the electrical housing inside the thermally conductive base by interlocking a plurality of ridges of the electrical housing with a plurality of grooves of the thermally conductive base. The method further comprises the step of disposing a bulb, over the LED assembly, on the first side of the thermally conductive base.

BRIEF DESCRIPTION OF THE DRAWINGS

In the accompanying drawings, structures are illustrated that, together with the detailed description provided below, describe exemplary aspects of the present teachings. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1B:
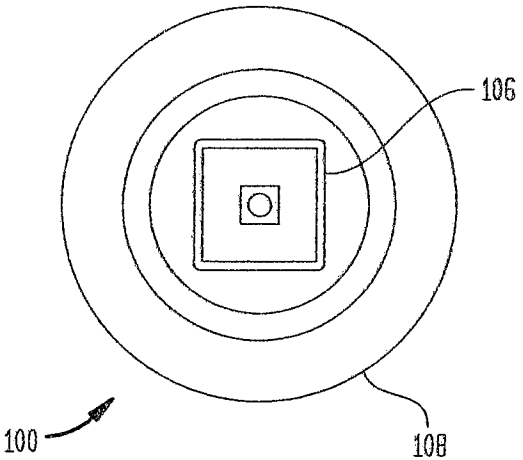
FIG. 1B illustrates a top view of an example filament LED lamp.
Figure 1A:
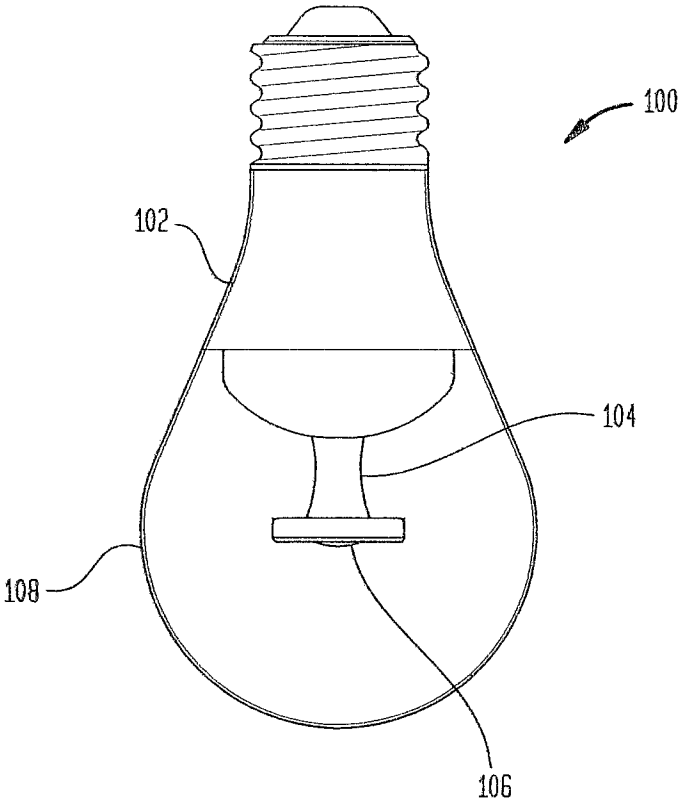
FIG. 1A. illustrates a side view of an example filament LED lamp.

FIGS. 1A and 1B illustrate a side view and a tope view, respectively, of an example filament LED lamp 100 (hereinafter referred to as lamp 100). Lamp 100 has a thermally conductive base 102 (hereinafter referred to as base 102) which acts as a heat sink and also conceals electronics (not shown) for powering lamp 100. Base 102 may be constructed of thermo-plastic, plastic, aluminum, or other suitable material capable of dissipating heat away from lamp 100.

Base 102 has a an appendage 104, or a small tower, protruding from a center of a first end, or top side, of base 102. Protruding appendage 104 is also thermally conductive. An LED assembly 106 is disposed at an end of protruding appendage 104 and in thermal communication with protruding appendage 104, and in turn with base 102. Lamp 100 has a bulb at the first end, enclosing protruding appendage 104 and LED assembly 106. Protruding appendage 104 protrudes in a direction towards the center of bulb 108. It protrudes approximately half way into the bulb so that LED assembly 106 is positioned approximately at the center of bulb 108.

Bulb 108 can be transparent so that protruding appendage 104 and LED assembly 106 are visible from outside bulb 108. In one example, bulb 108 is semi-transparent or non-transparent. In one example, bulb 108 is made of blow-molded plastic, thus giving bulb 108 a desired appearance. In the example illustrated in FIG. 1A, bulb 108 has a circumference at a bottom portion that is smaller than a circumference of a middle portion of bulb 108. In other words, bulb 108 may have a rounded shape. In another example, bulb 108 may be molded into other suitable forms or shapes, such a candle shape, a tube shape, and so on.

Figures 2A, 2B:
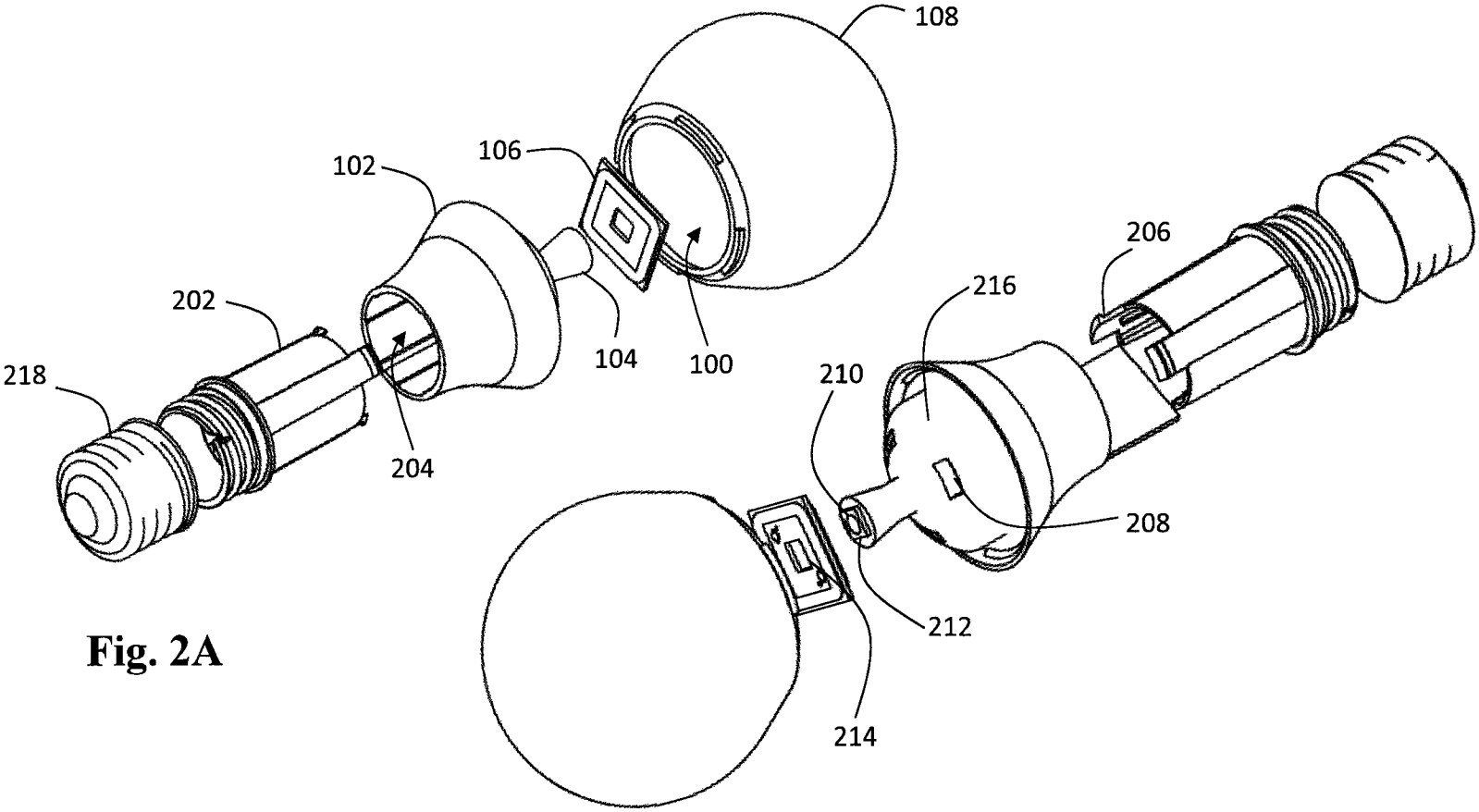
FIG. 2A. illustrates an exploded isometric view of the example filament LED lamp of FIGS. 1A and 1B.
FIG. 2B illustrates another exploded isometric view of the example filament LED lamp of FIGS. 1A and 1B.

FIGS. 2A and 2B illustrate exploded isometric views, from different angles respectively, of the example lamp 100 of FIGS. 1A and 1B. Lamp 100 further includes an electrical housing 202 for housing an electrical module (not shown) which provides power to LED assembly 106. Electrical housing 202 slides into a cavity 204, or empty space, inside base 102, through an opening on a second end or a back side of base 102, opposite protruding appendage 104.

Electrical housing 202 interlocks with base 102 for a secure coupling. Specifically, electrical housing 202 includes ridges 206 at a first end. When electrical housing is slid into cavity 204 of base 102, the ridges interlock with grooves 208 on base 102. In one example, electrical housing 202 is made of a dielectric plastic for insulating an electrical module.

Protruding appendage 104 has a channel (not shown) that connects cavity 204 to the top of protruding ridge 104 via appendage opening 210. The channel is a hollow space inside protruding ridge 104 that allows for wires and other suitable electrical connections to pass through, from an electrical module inside electrical housing 202 to LED assembly 106 at the top end of protruding appendage 104.

In one example, protruding appendage 104 includes a raised square platform 212 that surrounds appendage opening 210 at the top of protruding appendage 104. Raised square platform 212 aligns with a square cutout 214 on LED assembly 106 for efficient coupling of LED assembly 106 to protruding appendage 104. In one example, protruding appendage 104 is coupled to LED assembly 106 using an adhesive.

Lamp 100 also includes a screw cap 218 for forming electrical connections between lamp 100 and light fixtures such as lamps, ceiling lights, and so on.

Figure 3:
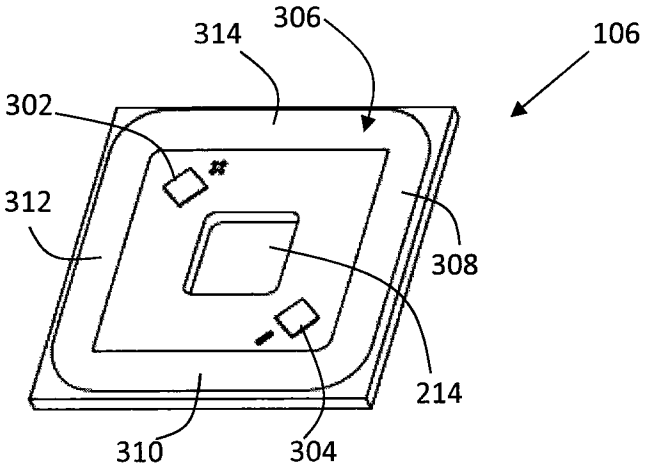
FIG. 3 illustrates an isometric view of an example LED assembly for use in the example filament LED lamp of FIGS. 1A and 1B.

FIG. 3 illustrates an isometric view of an example LED assembly 106 for use in the example lamp 100 of FIGS. 1A and 1B. LED assembly 106 has a first electrical contact point 302 and a second electrical contact point 304. First and second electrical contact points 302 and 304 are configured to make electrical contact with wires, or other suitable electrical connections, received from an electrical module housed in electrical housing 202, via channel 202, at square cutout 214.

LED assembly 106 has an LED 306 for producing light. LED 306 has a first linear portion 308, a second linear portion 310, a third linear portion 312, and a fourth linear portion 314. First, second, third, and fourth linear portions 308, 310, 312, and 314 are configured to form a square shape. In one example, LED assembly 106 may include four independent linear LEDs (not shown) positioned to form a square shape. In one example (not shown), LED assembly 106 may include more or less portions to create other suitable shapes such as, a triangle, a pentagon, and so on. In one example (not shown), portions of LED 306 may not be linear. For example, LED 306 may be circular shaped or round. LED assembly 106, including LED 306, disposed on top of protruding appendage 104, in combination with a transparent bulb 108 surrounding LED assembly 106, gives lamp 100 the appearance of an incandescent lamp which may be desirable to a user.

Lamp 100 is configurable to radiate light in the up or down direction. For example, LED assembly 106 may be positioned on protruding appendage 104 so that LED 306 faces either in a direction away from base 102 or towards base 102. Thus, flipping LED assembly 106 over changes the direction of light radiation. In one example, lamp 100 may be configured to radiate light in both directions, but not equally, regardless of how LED assembly is positioned. For example, if LED assembly 106 is positioned such that LED 306 faces up or away from base 102, lamp 100 may be configure to radiate a first percentage of produced light, such as 60% of the light, in the up direction and to radiate the remaining percentage, such as 40% of the light, in the down direction. Flipping LED assembly 106 over adjusts the light radiated by lamp 100 by causing lamp 100 to radiate a greater percentage of light in the down direction.

In one example, an inside portion 216 of base 102 may be coated with a light reflective paint, such as liquid or powder paints. A reflective coating enables lamp 100 to radiate light more effectively. It should be understood that, although inside portion 216 is illustrated as rounded, inside portion 216 may be other suitable shapes or forms capable of reflecting light according to desired performance of lamp 100.

Figure 4:
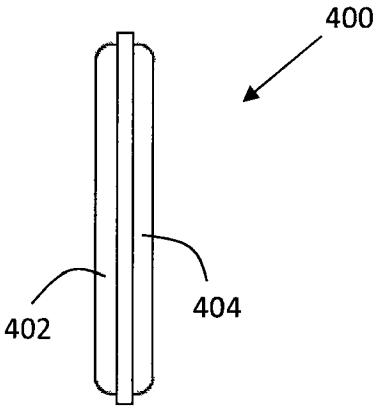
FIG. 4 illustrates a side view of the example LED assembly.

It should be understood that, although a single LED assembly 106 is illustrated, two LED assemblies may be used (not shown). For example, a first LED assembly may be positioned on protruding appendage 104 such that the LED is facing down, or towards base 102. A second inverted LED assembly may be positioned on protruding appendage 104, on top of the first LED assembly, such that the LED of the second LED assembly face up, or away from base 102. Thus, lamp 100 can be configured to radiate light equally in two directions, both up and down. In another example, lamp 100 may be configured to include a double sided LED assembly, as illustrated in FIG. 4 in order to radiate light equally in two directions. Specifically, an LED assembly 400 may include an LED 402 on a top side facing away from base 102 and an LED 404 on a bottom side facing towards base 102.

Figure 5:
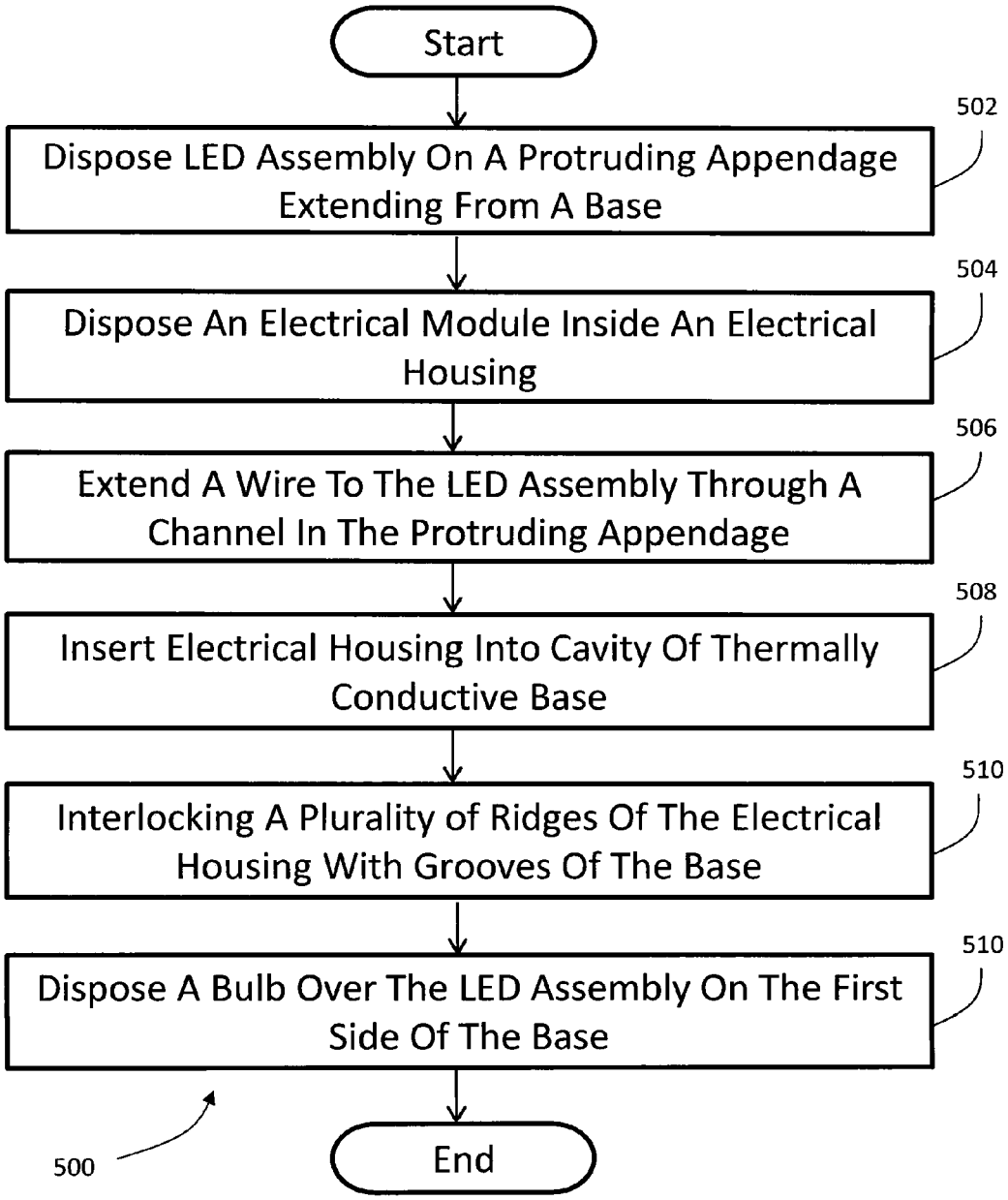
FIG. 5 is a flow chart illustrating a method for assembling a Filament LED lamp.

FIG. 5 is a flow chart illustrating a method for assembling a Filament LED lamp. At step 502, an LED assembly comprising an LED is disposed on a protruding appendage extending from the center of a first side of a thermally conductive base. At step 504, an electrical module is disposed inside an electrical housing. At step 506, a wire, coupled to the electrical module, is extended to the LED assembly, through a channel in the protruding appendage, the channel connecting an opening at the top of protruding appendage and a cavity inside the thermally conductive base. At step 508, the electrical housing is inserted into the cavity of the thermally conductive base, through an opening on a second side of the base. At step 510, the electrical housing is secured inside the thermally conductive base by interlocking a plurality of ridges of the electrical housing with a plurality of grooves of the thermally conductive base. At step 512, a bulb is disposed over the LED assembly, on the first side of the thermally conductive base.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of example aspects of the present disclosure thereof, and while the example aspects have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. An LED lamp comprising:

a thermally conductive base comprising an appendage protruding from a center of a first end and an opening to cavity on a second end, the appendage comprising a channel coupled to the cavity;

an LED assembly disposed at an end of the protruding appendage and in thermal communication with the base;

a bulb disposed on the first end, wherein the appendage protrudes in a direction towards the center of the bulb, and wherein the LED assembly is proximate to the center of the bulb; and an electrical housing, configured to house an electrical module, disposed inside the cavity of the base;

wherein an electrical wire disposed inside the channel electrically couples the LED assembly to the electrical module.

2. The LED lamp of claim 1, the electrical housing comprises a plurality of ridges at a first end configured to interlock with a plurality of grooves of the thermally conductive base.

3. The LED lamp of claim 1, wherein the LED assembly comprises an LED having one of a square shape and a round shape.

4. The LED of claim 3, wherein an LED having a square shape comprises a first linear portion, a second linear portion, a third linear portion, and a fourth linear portion, wherein the first, second, third, and fourth linear portions are configured to form a square shape.

5. The LED lamp of claim 3, wherein the LED is disposed on a first side of LED assembly, facing a direction away from the thermally conductive base.

6. The LED lamp of claim 5, wherein the LED assembly further comprises a second LED disposed on a second side of LED assembly, facing a direction towards the thermally conductive base.

7. The LED lamp of claim 3, further comprising a second inverted LED assembly comprising a second LED, wherein the second LED assembly is disposed at the end of the protruding appendage, facing a direction towards the thermally conductive base.

8. The LED lamp of claim 1, wherein the bulb comprises blow-molded plastic.

9. The LED lamp of claim 1, wherein the bulb is transparent, exposing the LED.

10. The LED lamp of claim 1, wherein the electrical housing comprises a dielectric plastic for insulating the electrical module.

11. The lamp of claim 1, wherein a circumference of a bottom portion of the bulb is smaller than a circumference of a middle portion of the bulb.

12. The lamp of claim 1, wherein the appendage comprises a square platform at the end, configured to align with a square cutout on the LED assembly.

13. The lamp of claim 1, wherein the LED assembly is secured to the end of the protruding appendage using an adhesive.

14. The lamp of claim 1, wherein the thermally conductive base is coated with a reflective paint coating.

15. A method for assembling a Filament LED lamp, comprising the steps of:

disposing an LED assembly comprising an LED on a protruding appendage extending from the center of a first side of a thermally conductive base;

disposing an electrical module inside an electrical housing;

extending a wire, coupled to the electrical module, to the LED assembly, through a channel in the protruding appendage, the channel connecting an opening at the top of protruding appendage and a cavity inside the thermally conductive base;

inserting the electrical housing into the cavity of the thermally conductive base, through an opening on a second side of the base;

securing the electrical housing inside the thermally conductive base by interlocking a plurality of ridges of the electrical housing with a plurality of grooves of the thermally conductive base; and disposing a bulb, over the LED assembly, on the first side of the thermally conductive base.

* * * * *